United States Patent [19]

Ishibashi et al.

[11] Patent Number: 4,871,940

[45] Date of Patent: Oct. 3, 1989

[54] COLOR DISPLAY TUBE WITH FIELD CONTROLLER

[75] Inventors: Masayuki Ishibashi, Chiba; Hiroshi Yoshioka, Mobara, both of Japan

[73] Assignee: Hitachi, Ltd., Tokyo, Japan

[21] Appl. No.: 12,997

[22] Filed: Feb. 10, 1987

[30] Foreign Application Priority Data

Mar. 7, 1986 [JP] Japan ..... 61-48302

[51] Int. Cl.[4] ..... H01J 29/51

[52] U.S. Cl. ..... 313/412; 313/413; 313/414; 313/431; 335/212

[58] Field of Search ..... 313/412, 409, 413, 414, 313/431; 335/212

[56] References Cited

U.S. PATENT DOCUMENTS

| | | | |
|---|---|---|---|
| 3,873,879 | 3/1975 | Hughes | 313/413 X |
| 4,245,160 | 1/1981 | Harao | 313/239 X |
| 4,473,773 | 9/1984 | Sakurai et al. | 313/412 |

*Primary Examiner*—Donald J. Yusko
*Assistant Examiner*—Michael Horabik
*Attorney, Agent, or Firm*—Antonelli, Terry & Wands

[57] ABSTRACT

There is provided a color display tube having an in-line electron gun for emitting a plurality of electron beams comprising a convergence device for converging the plurality of electron beams emitted from the electron gun onto a predetermined point by using a magnetic field, a deflection device for deflecting the electron beams converged by said convergence device by using a deflection magnetic field, and a field controller disposed between the convergence device and the deflection device in order to adjust the distribution of leakage magnetic field from the deflection device so as to make the leakage magnetic field exert influence upon respective electron beams uniformly, the field controller comprising a magnetic material having relative permeability of 3,000 H/m or more and coercive force of 0.025 Oe or less.

8 Claims, 4 Drawing Sheets

COLOR DISPLAY TUBE WITH FIELD CONTROLLER

BACKGROUND OF THE INVENTION

The present invention relates to a color display tube having an in-line electron gun equipped with a field controller, and in particular to a color display tube optimum to a color monitor display device of high resolution in which the electron beam is deflected with a horizontal scanning frequency higher than the standard horizontal scanning frequency.

In a color cathode-ray tube having an in-line electron gun, three electron beams are arranged on a line in a coplane. Therefore, two exterior beams among the in-line beams are eccentric with respect to the electromagnetic deflection center. The electron beam passing through the convergence electrode is deflected by the leakage magnetic field originating from the deflection yoke. At this time, the magnetic flux of the leakage magnetic field is not uniform over the section of the electron gun. Accordingly, the amount of deflection (deflection sensitivity) of the center beam is different from that of the exterior beams. As a result, the shape of the raster formed by the scanning of the center beam (green) is different from that formed by the scanning of each of the exterior beams (red and blue). The so-called coma aberration is generated, resulting in poor color reproduction at comparatively exterior parts on the screen.

In order to compensate the coma aberration, a field controller for controlling the magnetic flux distribution of the leakage magnetic flux at the rear end side of the deflection yoke is disposed in a region through which the electron beam passes. This field controller is made of a magnetic material having high permeability.

A color display tube having such a field controller is disclosed in Japanese Examined Patent Publication No. 26208/76 assigned to the Tokyo Shibaura Electric Industrial Company and filed May 18, 1971, for example.

In the standard color television system, 15.75 kHz is generally used as the horizontal scanning frequency $f_H$. In recent years, higher resolution is demanded for the picture on the display monitor device of the computer terminal. Therefore, a higher frequency as compared with the standard system tends to be chosen as the horizontal scanning frequency. As a result, coma distortion is caused. In particular, especially large distortion is caused on the left side of the screen, resulting in a problem.

The present inventors took note of this phenomenon and conducted experiments. As a result, the present inventors found that a higher deflection field frequency deteriorates the magnetic characteristics of the field controller and hence the desired compensation function for the leakage magnetic field is lost, resulting in the above described problem. That is to say, the increase in the deflection magnetic field frequency (horizontal scanning frequency) causes an increase in eddy-current loss of the field controller. Thus the permeability of the field controller is lowered and hence the effect of the magnetic shield or the magnetic enhancement is deteriorated. When the horizontal scanning frequency is raised in the case of the field controller functioning the magnetic shield, the deflection amount of the center beam becomes small and the deflection amount of the exterior beam becomes large. In the case of the field controller functioning the magnetic enhancement the contrary becomes true. Further, an increase in the horizontal scanning frequency shortens the horizontal . retrace line time. Due to the magnetic aftereffect, the amount of misconvergence between the center beam and the exterior beams becomes large especially on the left side of the screen.

SUMMARY OF THE INVENTION

An object of the present invention is to provide a color display tube wherein the magnetism deterioration of the field controller caused by using a higher frequency as the horizontal deflection frequency is reduced and the degradation in convergence grade is prevented.

In order to achieve the above described object, the color display tube according to the present invention includes a field controller comprising a material having high permeability and low coercive force.

DESCRIPTION OF THE PREFERRED EMBODIMENTS

An embodiment of the present invention will now be described by referring to drawings.

Figure 1:
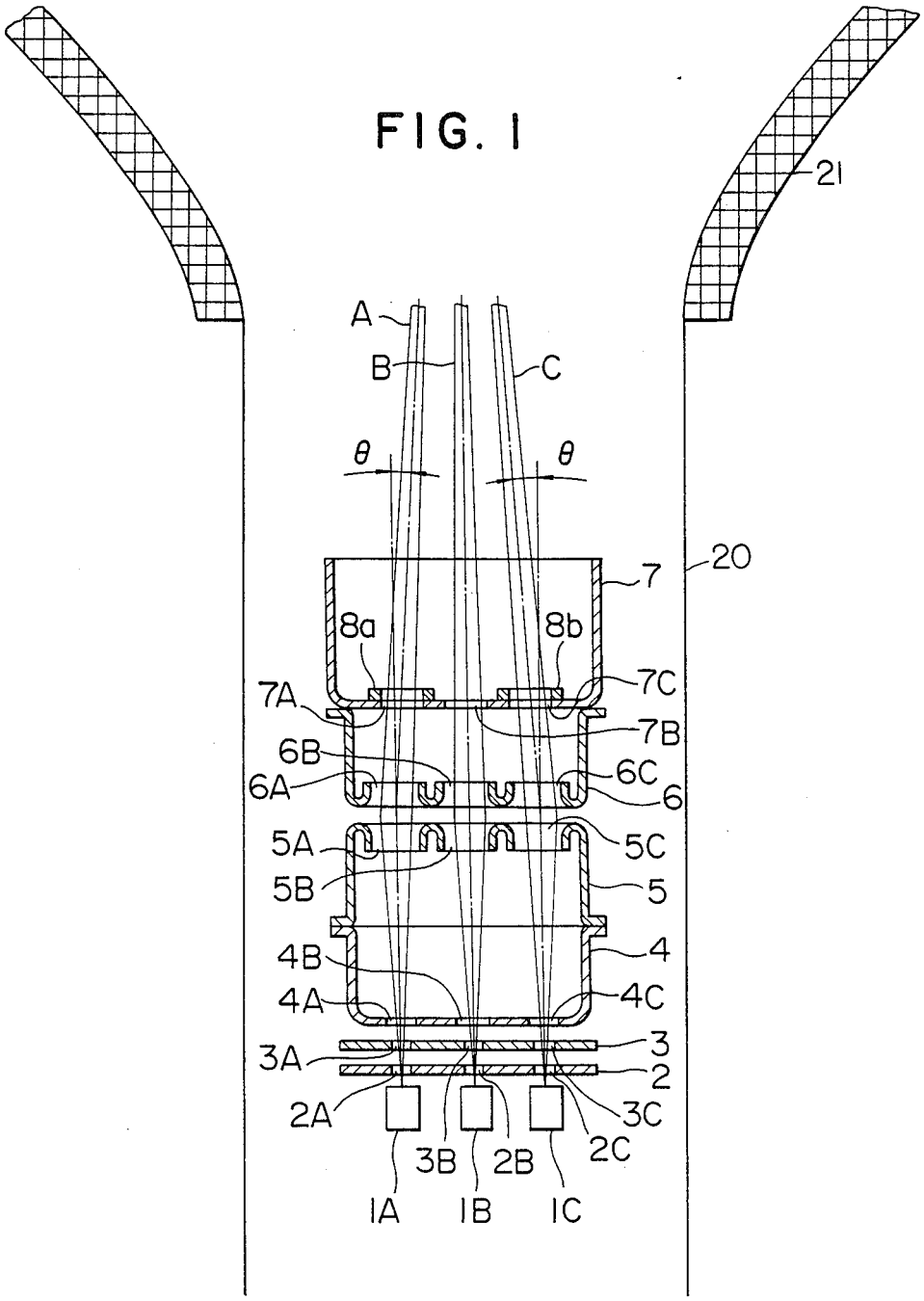
FIG. 1 is a sectional view of an electron gun for illustrating an embodiment of a color cathode-ray tube according to the present invention.
Figure 2:
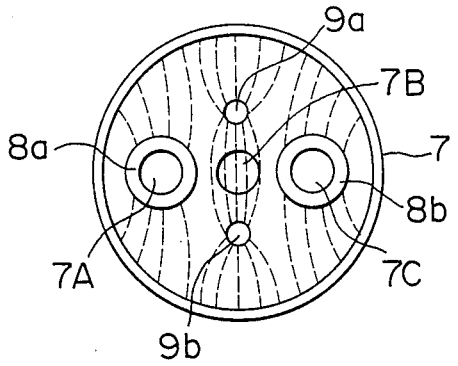
FIG. 2 is a plane view of a convergence electrode of FIG. 1 seen from the fluorescent screen side.

FIG. 1 is a sectional view of a principal part of an in-line electron gun for illustrating an embodiment of a color display tube with an envelope 20 and a deflection yoke 21 according to the present invention. In FIG. 1, cathodes 1A, 1B and 1C emitting respective one of three electron beams from respective vertex planes, the first grid 2 for controlling the electron beam, the second grid 3 for accelerating the electron beam, and a lower part 4 of the third grid for focusing the electron beam are illustrated. Numerals 2A, 2B, 2C, 3A, 3B, 3C, 4A, 4B and 4C denote holes for passing three electron beams. Numerals 5 and 6 denote an upper part of the third grid and the fourth grid respectively. In conjunction with three diaphragm holes 5A, 5B and 5C disposed on the bottom of the upper part 5 of the third grid, three diaphragm holes 6A, 6B and 6C disposed on the bottom of the fourth grid 6 so as to be opposed to the diaphragm holes 5A, 5B and 5C constitute three main lenses corresponding to three electron beams. A convergence electrode 7 is fixedly disposed on the opening end side of the fourth grid 6. The convergence electrode 7 has holes 7A, 7B and 7C for passing three electron beams. The plane view of the convergence electrode 7 is shown in FIG. 2. The first field controllers 8*a* and 8*b* taking the shape of a ring are fixedly disposed on the peripheries of the exterior beam passing holes 7A and 7C, respectively. The second field controllers 9*a* and 9*b* taking the shape of a thin disc are fixedly disposed above and below the center beam passing hole 7B. For the field controllers 8*a*, 8*b*, 9*a* and 9*b*, a material having small hysteresis loss, eddy-current loss and magnetic aftereffect and having fine magnetic characteristics at high frequencies is chosen.

Results of the experiment for choosing the material will be described later. The experimental results obtained by the present inventors indicate that 78% Ni—Cu—Mo system permalloy is desirable as the material of the field controller. The field controllers 8*a*, 8*b*, 9*a* and 9*b* are obtained by pressing a plate of the above described material and annealing the plate.

In FIG. 2, broken lines represent the leakage magnetic field coming from the horizontal deflection yoke. The first field controllers 8*a* and 8*b* serve as the field with respect to the leakage magnetic field, while the second field controllers 9*a* and 9*b* function to concentrate the magnetic flux. In the vicinity of the center electron beam passing hole 7B, the magnetic flux density becomes high. In the vicinity of the exterior electron beam passing holes 7A and 7C, the magnetic flux density becomes coarse.

Figure 3:
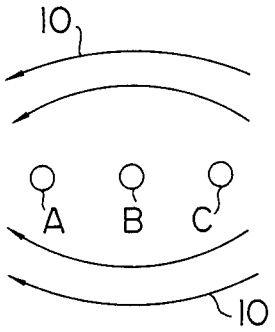
FIGS. 3 and 4 are magnetic field diagrams of an electromagnetic deflection yoke of an in-line color display tube.
Figure 4:
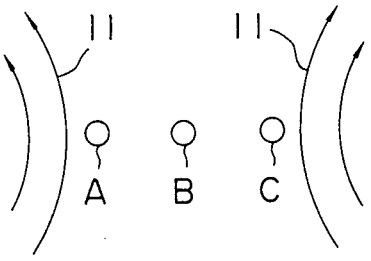

In this configuration, the electron beam amounts of the three electron beams A, B and C are controlled by means of signal voltage values applied to three cathodes 1A, 1B and 1C, respectively. The three electron beams A, B and C then undergo somewhat focusing function in prefocus lenses formed between opposing holes of the second grid 3 and the lower part 4 of the third grid. Thereafter the three electron beams A, B and C are focused to form an image on a fluorescent screen of the cathode-ray tube, which is not illustrated, by respective main lenses formed by the upper part 5 of the third grid and the fourth grid 6. The beam passing holes 6A and 6C of the fourth grid 6 are slightly eccentric toward the outside with respect to the beam passing holes 5A and 5C of the upper part 5 of the third grid. This eccentricity supplies the exterior beams A and C with inclination of angle $\theta$ toward the center beam B. Three electron beams A, B and C pass through beam passing holes 7A, 7B and 7C of the convergence electrode 7. In addition, the exterior beams A and C pass through the field controllers 8*a* and 8*b*. The color cathode-ray tube has deflection coils at its funnel portion. By making the magnetic field produced by the vertical deflection coil barrel-shaped as shown in FIG. 3 and making the magnetic field produced by the horizontal deflection coil pincushion-shaped as shown in FIG. 4, it is possible to focus three electron beams passing through the convergence electrode 7 correctly onto one position on the fluorescent screen. In FIGS. 3 and 4, numerals 10 and 11 denote vertical deflection magnetic field and horizontal deflection magnetic field.

Figure 5:
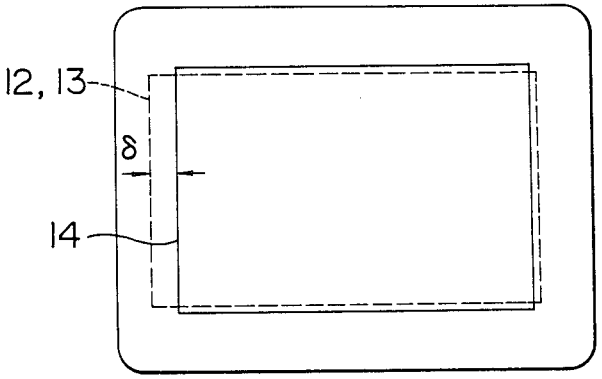
FIG. 5 is a convergence pattern diagram.

FIG. 5 shows a misconvergence (coma aberration) state in which rasters obtained by scanning of respective beams do not agree each other due to the use of the horizontal scanning frequency higher than the standard value. As described before, an increase in horizontal scanning frequency degrades the magnetic characteristics of the field controller as compared with the initial state, resulting in deteriorated characteristics of the magnetic substance. Therefore, the difference between amounts of deflection of electron beams caused by the nonuniform distribution of the leakage deflection magnetic field comes to the front. As a result, a raster 14 produced by the center electron beam (green) and represented by solid lines does not agree with rasters 12 and 13 produced by the exterior electron beams (red and blue) and represented by broken lines. The amount $\delta$ of misconvergence (i.e., the amount of deflection deficiency of the center beam B with respect to the exterior beams A and C) becomes significant as the horizontal deflection frequency is raised.

Figure 6:
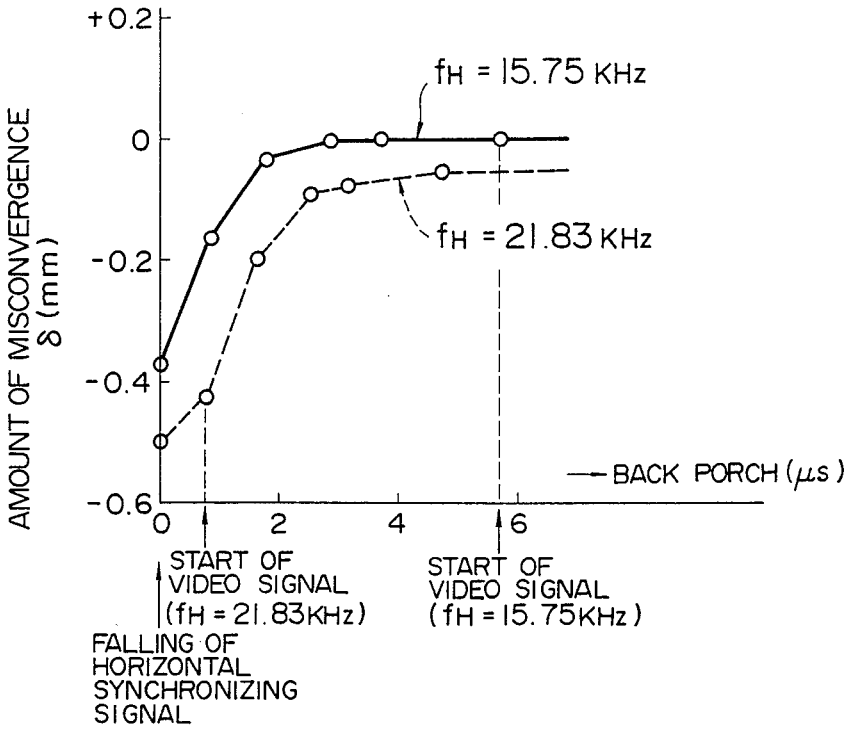
FIGS. 6 and 7 are graphs showing convergence characteristics of a conventional field controller when different horizontal scanning frequencies are used.
Figure 7:
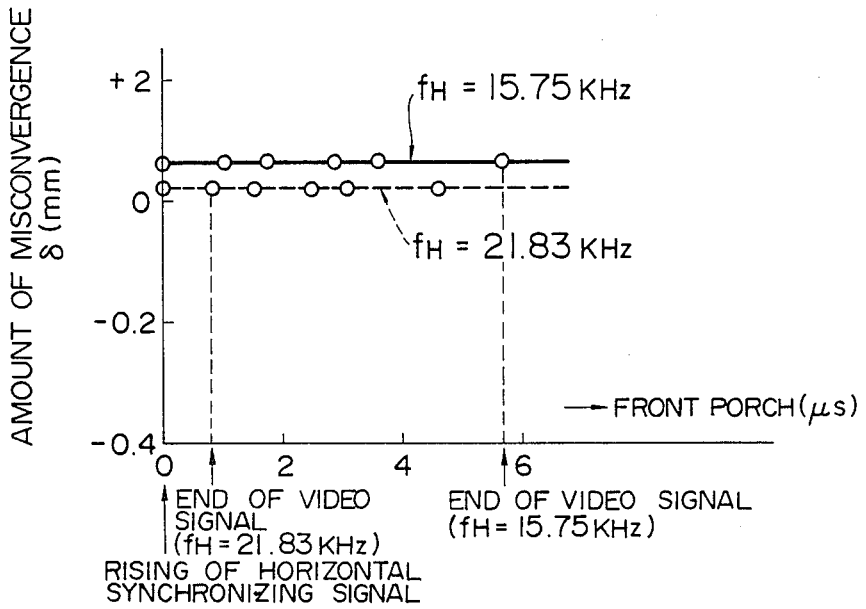

FIGS. 6 and 7 are graphs for comparing the amount $\delta$of misconvergence measured when the horizontal scanning frequency $f_H$ is a standard value, i.e., 15.75 kHz with that measured when the horizontal scanning frequency $f_H$ is raised to 21.83 kHz. Measurement was made under the condition that the field controller was made of a conventional magnetic substance comprising 45% Ni. FIG. 6 shows the convergence characteristics on the left side of the screen, while FIG. 7 shows the convergence characteristics on the right side of the screen. In both figures, the ordinate represents the deviation $\delta$ of the raster 14 produced by the center beam from the rasters 12 and 13 produced by the exterior beams. The symbol − indicates that the raster 14 exists outside the rasters 12 and 13, while the symbol + indicates that the raster 14 exists inside the rasters 12 and 13. The abscissa of FIG. 6 represents the back porch ($\mu$s) which is a time period ranging from the falling point of the horizontal synchronization signal to the starting point of the video signal. The abscissa of FIG. 7 represents the front porch ($\mu$s) which is a time period ranging from the end point of the video signal to the rising point of the horizontal synchronizing signal. It is to be noted that the time periods of the back porch and the front porch become shorter as the horizontal scanning frequency is raised in both figures. Assuming that the abscissa of FIG. 6 is replaced by the horizontal position on the screen, the video signal starting point indicated by an arrow may be substantially regarded as the starting point (left end) of the raster. It is apparent from FIG. 6 that at both frequencies the transition phenomenon degrades the magnetic characteristics of the field controller and hence increases the misconvergence $\delta$ at the portion where the horizontal synchronizing signal is switched to the horizontal scanning signal which is lower than the horizontal synchronizing signal. This is the magnetic aftereffect phenomenon. Further, it is understood that the amount of misconvergence $\delta$ is entirely increased due to an increase in eddy-current loss of the magnetic substance when the horizontal scanning frequency $f_H$ is raised from the standard value of 15.75 kHz to 21.83 kHz. When the horizontal scanning frequency $f_H$ is 15.75 kHz, there is little misconvergence $\delta$ because the back porch is long and the left end of the raster is sufficiently apart from the portion where the misconvergence is generated (the portion of the magnetic aftereffect). When the horizontal scanning frequency $f_H$ is chosen to be 21.83 kHz, however, the back porch becomes short and the left end of the raster moves to the left side of FIG. 6. Therefore, the vicinity of the left side of the raster is completely affected by the magnetic aftereffect, the misconvergence being not negligible. FIG. 7 shows the amount of misconvergence appearing on the right side of the screen and is almost free from the magnetic aftereffect. Even if the horizontal scanning frequency is changed, the amount of misconvergence is permissible.

Figure 8:
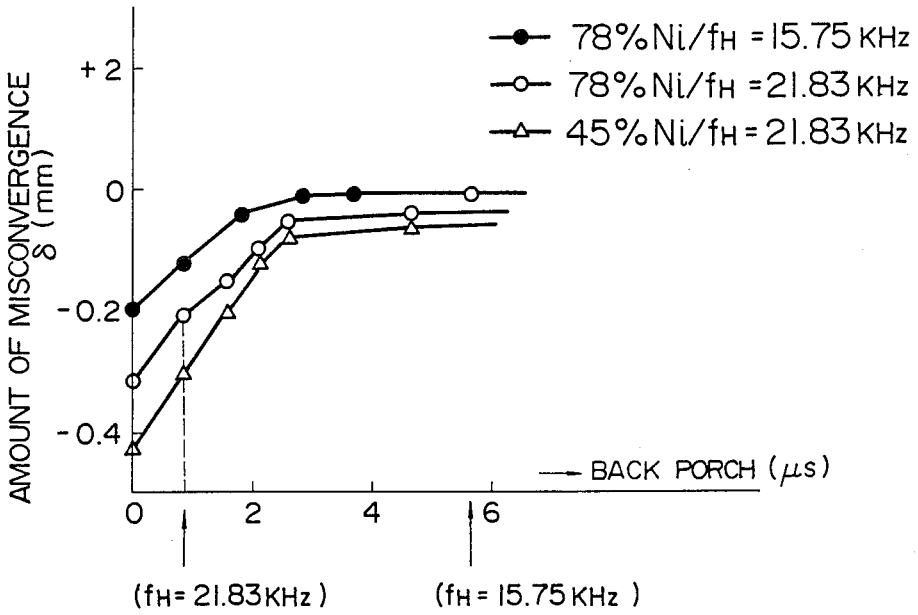
FIG. 8 is a graph for comparing convergence characteristics of a field controller according to the present invention with those of a conventional field controller.

FIG. 8 shows the misconvergence characteristics of the field controller using the material according to the present invention as compared with the misconvergence characteristics of the field controller using a conventional material. A plot of FIG. 8 comprising triangular marks represents the misconvergence characteristics appearing on the left side of the screen obtained when the field controller made of a conventional magnetic material containing 45% Ni is used with the horizontal scanning frequency $f_H$=21.83 kHz. A plot of FIG. 8 comprising white dots represents the misconvergence characteristics appearing on the left side of the screen obtained when a field controller made of 78% Ni—Cu—Mo system permalloy according to the present invention is used with the horizontal scanning frequency $f_H$=21.83 kHz. A plot of FIG. 8 comprising black dots represents the misconvergence characteristics appearing on the left side of the screen obtained when the same field controller according to the present invention is used with the horizontal scanning frequency $f_H$=15.75 kHz (standard value). As is evident from FIG. 8, the magnetic aftereffect is reduced in the field controller according to the present invention. Even at the left end of the raster, the amount $\delta$ of misconvergence is approximately −0.2 mm and well in the permissible range.

In the embodiment of the present invention, 78% Ni—Cu—Mo system permalloy was used. This was chosen as the material satisfying the magnetic characteristics condition imposed upon the field controller, i.e., the condition that the permeability is 3,000 H/m (Henry/meter) or more and the coercive force is 0.025 Oe (Oersted) or less. So far as the condition is satisfied, any material other than 78% Ni—Cu—Mo system permalloy may be used. The permeability value of the magnetic material can be generally increased by increasing the content ratio of Ni. Depending upon the value of the content ratio, however, the volume resistivity associated with the coercive force might become small, resulting in an increased eddy-current loss. The permeability was defined to be 3,000 H/m or more so as to sufficiently compensate the misconvergence by the shield or enhancement effect of the leakage magnetic field during the period of FIG. 8 free from the magnetic aftereffect, i.e., during the static deflection field period. Further, the coercive force affects the eddy-current loss in alternating current magnetic field. Therefore, the decrease in permeability caused by the eddy-current loss in the high frequency magnetic field can be constrained by making the coercive force small as far as possible. The coercive force was defined to be 0.025 Oe or less so as to sufficiently reduce the eddy-current and let the amount of misconvergence due to the magnetic aftereffect fall in the permissible range.

Figure 9:
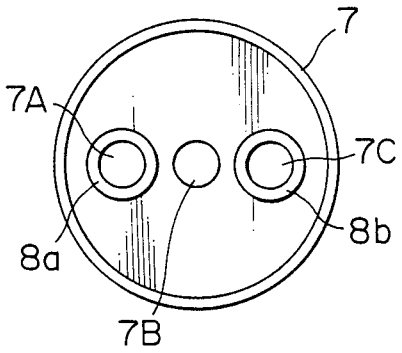
FIGS. 9 and 10 are plane views of other embodiments of the present invention seen from the fluorescent screen side of the convergence electrode.
Figure 10:
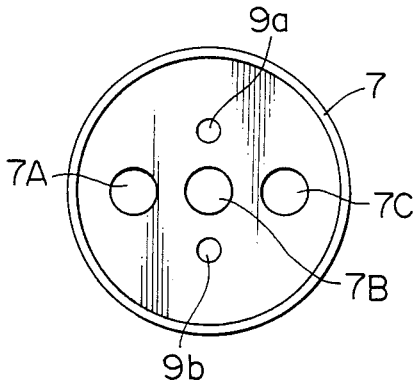

In the above described embodiment, the first field controllers 8*a* and 8*b* are disposed on the peripheries of the exterior beam passing holes 7A and 7C, and the second field controllers 9*a* and 9*b* are disposed above and below the center beam passing hole 7B. However, the present invention is not limited thereto. Even if only the first field controllers 8*a* and 8*b* are disposed on the peripheries of the exterior beam passing holes 7A and 7C as shown in FIG. 9 or only the second field controllers 9*a* and 9*b* are arranged above and below the center beam passing hole 7B as shown in FIG. 10, for example, a similar effect can be obtained more or less.

We claim:

1. A color display tube for operating at a horizontal scanning frequency greater than the standard horizontal scanning frequency and having an in-line electron gun for emitting a plurality of electron beams comprising:

a convergence device for converging said plurality of electron beams emitted from said electron gun onto a predetermined point by using a magnetic field;

a deflection device for deflecting the electron beams converged by said convergence device into a predetermined direction by using a deflection magnetic field; and a field controller disposed between said convergence device and said deflection device in order to adjust magnetic flux distribution of leakage magnetic field from said deflection device so as to make said leakage magnetic field exert influence upon respective electron beams uniformly, said field controller comprising a magnetic material having relative permeability of 3,000 H/m or more and coercive force of 0.025 Oe or less.

2. A color display tube according claim 1, wherein said field controller comprises a material which is substantially 78% in content of nickel.

3. A color display tube according to claim 2, wherein said field controller comprises 78% Ni—Cu—Mo system permalloy.

4. A color display tube according to claim 3, wherein said in-line electron gun emits three electron beams and said convergence device delimits a plane having holes in-line arranged thereon for passing said three electron beams, and wherein said field controller is disposed on at least one of the peripheries of exterior holes among said in-line arranged holes and a line extending transversely to said in-line arranged holes and passing through a center hole among said in-line arranged holes so as to be disposed above and below said center hole.

5. A color display tube having an in-line electron gun for emitting a plurality of electron beams and operable at a horizontal scanning frequency greater than the standard horizontal scanning frequency of 15.7 kHz, comprising:

a convergence device for converging said plurality of electron beams emitted from said electron gun onto a predetermined point by using a magnetic field;

a deflection device for deflecting the electron beams converged by said convergence device into a predetermined direction by using a deflection magnetic field; and field controller means disposed between said convergence device and said deflection device for adjusting magnetic flux distribution of leakage magnetic field from said deflection device so as to make said leakage magnetic field exert influence upon respective electron beams uniformly at least when said color display tube is operated at the greater horizontal scanning frequency, said field controller means including a magnetic material having a relative permeability of at least 3,000 H/m and a coercive force no greater than 0.025 Oe.

6. A color display tube according to claim 5, wherein said field controller means includes a material which is substantially 78% in content of nickel.

7. A color display tube according to claim 6, wherein said field controller means comprises 78% Ni—Cu—Mo system permalloy.

8. A color display tube according to claim 5, wherein said color display tube is operated at a horizontal scanning frequency of about 21.83 kHz.

* * * * *